United States Patent [19]

Weiswurm

[11] Patent Number: 4,676,139

[45] Date of Patent: Jun. 30, 1987

[54] VALVE MECHANISM FOR OPERATING A PISTON WITHIN A CYLINDER

[75] Inventor: Klaus D. Weiswurm, San Antonio, Tex.

[73] Assignee: Centrifugal Piston Expander, Inc., San Antonio, Tex.

[21] Appl. No.: 777,052

[22] Filed: Sep. 17, 1985

[51] Int. Cl.[4] ..... F01L 15/14

[52] U.S. Cl. ..... 91/265; 91/341 R; 91/350; 91/395; 91/410

[58] Field of Search ..... 91/397, 405, 407, 408, 91/409, 410, 265, 341 R, 350, 395

[56] References Cited

U.S. PATENT DOCUMENTS

| | | | |
|---|---|---|---|
| 2,783,742 | 3/1957 | Shafer | 91/407 |
| 3,877,344 | 4/1975 | Langland | 91/407 |
| 4,043,787 | 8/1977 | Foster | 91/408 |
| 4,233,885 | 11/1980 | Deschner | 91/410 |
| 4,240,329 | 12/1980 | Inhofer | 91/397 |
| 4,397,218 | 8/1983 | Spring | 91/407 |
| 4,586,426 | 5/1986 | Dibrell | 91/410 |
| 4,589,257 | 5/1986 | Schaich | 60/670 |

*Primary Examiner*—Abraham Hershkovitz
*Attorney, Agent, or Firm*—Norvell & Associates

[57] ABSTRACT

A valving mechanism for a cylinder-piston unit wherein the extreme positions of the piston are not positively controlled by a crankshaft or similar device. Inlet and exhaust valves are respectively mounted in a cylinder head and are operated by actuating rods projecting into the path of the piston.

6 Claims, 4 Drawing Figures

VALVE MECHANISM FOR OPERATING A PISTON WITHIN A CYLINDER

BACKGROUND OF THE INVENTION

1. Field of the Invention

The invention relates to a valve mechanism for controlling the motions of a piston relative to a cylinder, wherein the piston is not connected to any crankshaft or similar device for limiting the extreme displacements of the piston relative to the cylinder.

2. History of the Prior Art

There are a large number of piston-cylinder arrangements disclosed in the prior art wherein the piston is not connected to a crankshaft which accurately controls the extreme positions of the piston relative to the cylinder. In such apparatus, it is necessary to control the operation of inlet and exhaust valves in the cylinder head so that the exhaust valve is open as the piston approaches the cylinder head, thus offering minimum resistance to the piston movement, but is closed prior to the piston reaching the cylinder head so as to provide a cushion of gas to arrest the movement of the piston without damaging the cylinder head. The same mechanism requires a special inlet valve, which is closed while the piston is remote from the cylinder head but is opened to introduce pressured gas into the cylinder as the piston is brought to a stop adjacent the cylinder head. See, for example, the valving construction disclosed and claimed in co-pending application Ser. No. 617,288 filed June 4, 1984 and assigned to the Assignee of the Instant Application. The prior art valving mechanisms for such piston-cylinder mechanisms have not been entirely reliable in their performance.

SUMMARY OF THE INVENTION

This invention provides piston-actuated inlet and exhaust valves for a cylinder that has a piston reciprocably mounted therein and wherein the motion of the piston is not positively controlled by a crankshaft or similar mechanical means. Such valving mechanism comprises a cylinder head suitably mounted on one end of the cylinder and defining a generally cylindrical inlet chamber which is connected to a suitable source of pressured gas. A bore is provided through the cylinder head which is concentric with the axis of the gas inlet chamber, and a plurality of inlet passages are provided in peripherally spaced relationship around such bore and extending between the gas inlet chamber and interior of the cylinder. An annular valve seat is formed on the cylinder head surrounding all of the outer ends of the fluid inlet passages. A tubular valve is slidably mounted within the cylindrical inlet chamber, and one end of such valve defines an annular end face sealingly engagable with the valve seat.

A valve-actuating rod is slidably mounted in the bore of the tubular valve member and has a larger diameter portion slidably mounted in the cylinder head bore and projecting into the interior of cylinder, hence, into the path of the piston as it moves towards the cylinder head. Thus, the actuating rod is moved outwardly by the piston as the piston approaches the cylinder head. Such movement is opposed by a suitable spring operating between the cylinder head and the valve-actuating rod.

A lost-motion connection is provided between the valve-actuating rod and the tubular valve so that the piston is at its desired limiting position with respect to the cylinder head, or very close thereto, before the actuating rod engages the tubular valve and lifts the same from the valve seat to permit a flow of pressured gas into the cylinder. Such pressured gas, of course, effects an immediate reversal of the motion of the piston and drives the piston away from the piston head. The required axial movement of the tubular valve to effect the opening of the inlet passages for pressured gas flow into the cylinder, is very short. Prior art constructions of such valve were thus subject to an immediate closing of the inlet valve after limited movement of the piston away from the cylinder head, thus limiting the flow of pressured gas into the cylinder.

The tubular valve incorporating this invention overcomes this problem by first, providing a lost-motion connection between the piston and the inlet valve, and secondly, by automatically providing a fluid pressure bias to hold the valve in its open position until it is forcibly returned by the compressed spring opposing the movement of the actuating rod. Such spring will not be effective, however, until the piston has moved a substantial distance away from the cylinder head. A differential fluid pressure is applied to the tubular valve member to hold it in its open position through the expedient of providing an axial projection on the outer end of the tubular valve which slidably and sealably engages a bore in the end of the gas inlet chamber counter bore in the tubular valve member immediately adjacent to the aforementioned end face and surrounding the actuating rod. This projection creates an excess area of inwardly facing surfaces on the tubular valve over the area of outwardly facing surfaces, and the gas pressure acting on such excess area of inwardly facing surfaces automatically forces the valve outwardly to hold it in its open position. Additionally, the opening movement of the valve is preferably limited by an annular ring which is mounted in the cylinder and which cooperates with an outwardly facing shoulder on the tubular valve to effectively seal off that outwardly facing surface as the valve is driven outwardly by the action of the piston. This further augments the pressure-biasing force imposed on the valve and, thus, it is assured that the inlet valve will remain in its open position until the piston has been moved a substantial distance away from the cylinder head.

It is not sufficient to provide just a special inlet valve for this type of piston-cylinder arrangement. Additionally, a special exhaust valve must be provided which remains open during the time that the piston is approaching the cylinder head, so as to minimize resistance to such movement of the piston, but is then closed as the piston head approaches the desired limiting position with respect to the cylinder head so as to build up a compressed cushion of gas to arrest the movement of the piston. Moreover, the exhaust valve must remain closed as long as the gas pressure in the cylinder remains in excess of the atmospheric or ambient pressure to which the exhaust valve is connected.

An exhaust valve embodying this invention comprises a second bore in the cylinder head extending into the cylinder from a chamber communicating with the atmosphere or a gas discharge passage. A plurality of gas exhaust passages are mounted in peripherally spaced relationship around the second bore. The exhaust valve comprises a T-shaped member having a stem portion slidably mounted in the second bore and a head portion engageable with a second annular seating surface surrounding all of the inner ends of the peripherally spaced exhaust passages. A relatively light spring maintains the exhaust valve in a normally open position. The exhaust valve is moved to a closed position by a plunger which is mounted in the body of the exhaust valve and biased inwardly into the cylinder and into the path of the oncoming piston by a compression spring. When the piston strikes the actuating rod for the exhaust valve, it imparts an outwardly directed force to the exhaust valve, moving such valve to its closed position. The exhaust valve remains in its closed position until the gas pressure in the cylinder is reduced to a level which permits the relatively light spring to move the head of the exhaust valve to an open position. The reduction of pressure in the cylinder may be accomplished in any conventional manner, for example, by the passage of the piston past one or more radially disposed exhaust ports. The exhaust valve remains in the open position as the piston returns toward the cylinder head and again contacts the actuating rod for the exhaust valve to close same and repeat the cycle of operations.

Further advantages of this invention will be readily apparent from the following detailed description thereof, taken in conjunction with the annexed sheets of drawings, on which is shown a preferred embodiment of the invention.

DESCRIPTION OF PREFERRED EMBODIMENT

Figure 3:
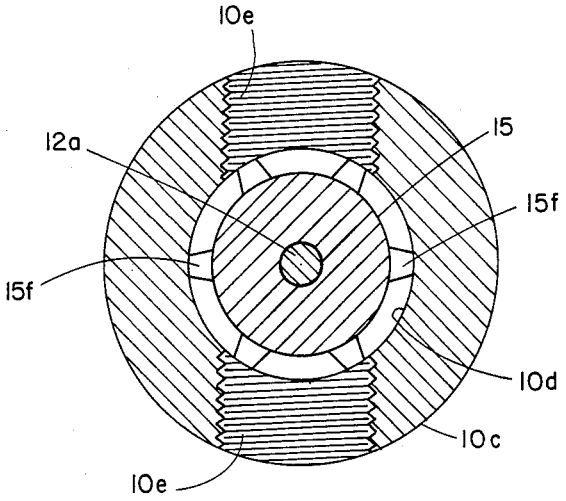
FIG. 3 is a sectional view taken on the plane 3—3 of FIG. 2.
Figure 1:
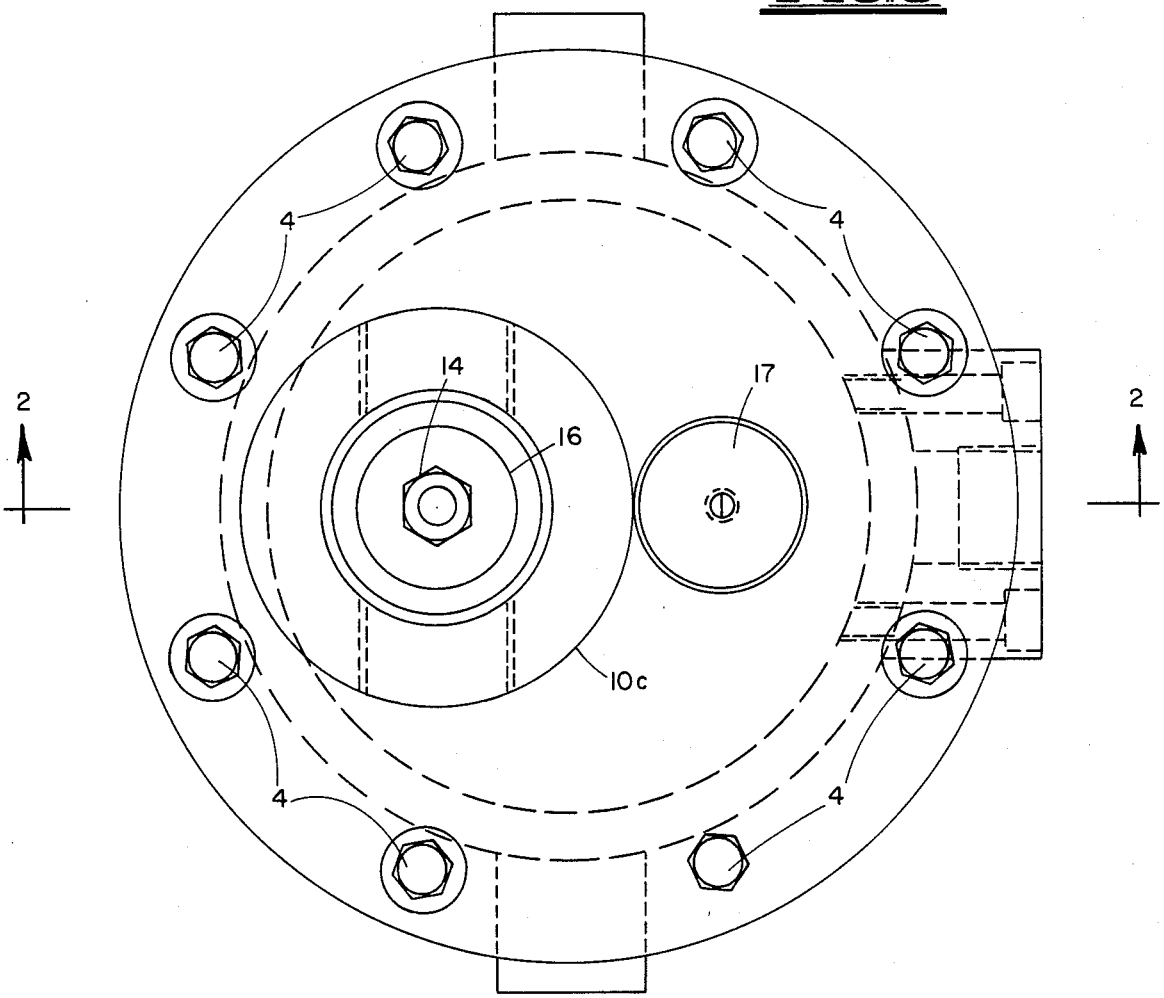
FIG. 1 is an end elevational view of a cylinder head incorporating a valving mechanism embodying this invention.

Referring to the drawings, a conventional cylinder 1 defines a cylindrical bore 1*a* within which a conventional piston 2 is axially reciprocable. Piston 2 is not connected to any crankshaft or similar mechanism for limiting its axial movement with respect to the cylinder 1. The piston may, for example, comprise one of the pistons shown in co-pending applications; Ser. No. 617,288, filed June 4, 1984, and Ser. No. 678,439 filed Dec. 5, 1984, both of said co-pending applications being assigned to the Assignee of the Instant Application.

Around the outer extremity of cylinder 1, there is provided an annular ring-retaining recess 1*b* within which is mounted an axially split retaining ring 3. A cylinder head 10 is then bolted in sealed relationship to the end face of cylinder 1 by a plurality of peripherally spaced bolts 4 which are threadably engaged with suitable holes provided in the retaining ring 3. An annular O-ring seal 5 is trapped between the end face of cylinder 1 and a radial surface 10*a* formed on the cylinder head 10 to seal the connection.

Cylinder head 10 comprises a generally cylindrical body portion 10*b* and an axially extending, eccentrically positioned cylindrical extension 10*c* which defines a pressured fluid inlet chamber 10*d* which is supplied with pressured gas through suitable radial ports 10*e*.

A bore 10*f*, concentrically disposed relative to the inlet chamber 10*d*, communicates between the pressured fluid inlet chamber 10*d* and an enlarged-diameter counter bore 10*k*, which is in full communication with the interior of the cylinder 1. Additionally, a plurality of peripherally spaced, axially extending inlet passages 10*g* are provided in closely surrounding relationship to the bore 10*f*. An annular sealing surface 10*h*, which is preferably of radial configuration, is provided in surrounding relationship to all of the fluid inlet passages 10*g*.

A tubular inlet valve 15 is mounted for axially slidable movements within the bore of the cylindrical fluid inlet chamber 10*d*. The main body portion of inlet valve 15 is of inverted cup-shaped configuration defining an enlarged counter bore 15*a*.

A plurality of peripherally spaced radial flanges 15*f* cooperate with the cylindrical wall of inlet chamber 10*d* to guide the axial movements of tubular inlet valve 15. Additionally, an axial extension 15*e* of valve 15 slidably and sealably engages the bore 13*a* of an abutment ring 13 which is secured in chamber 10*d* by C-ring 13*b*.

Figure 4:
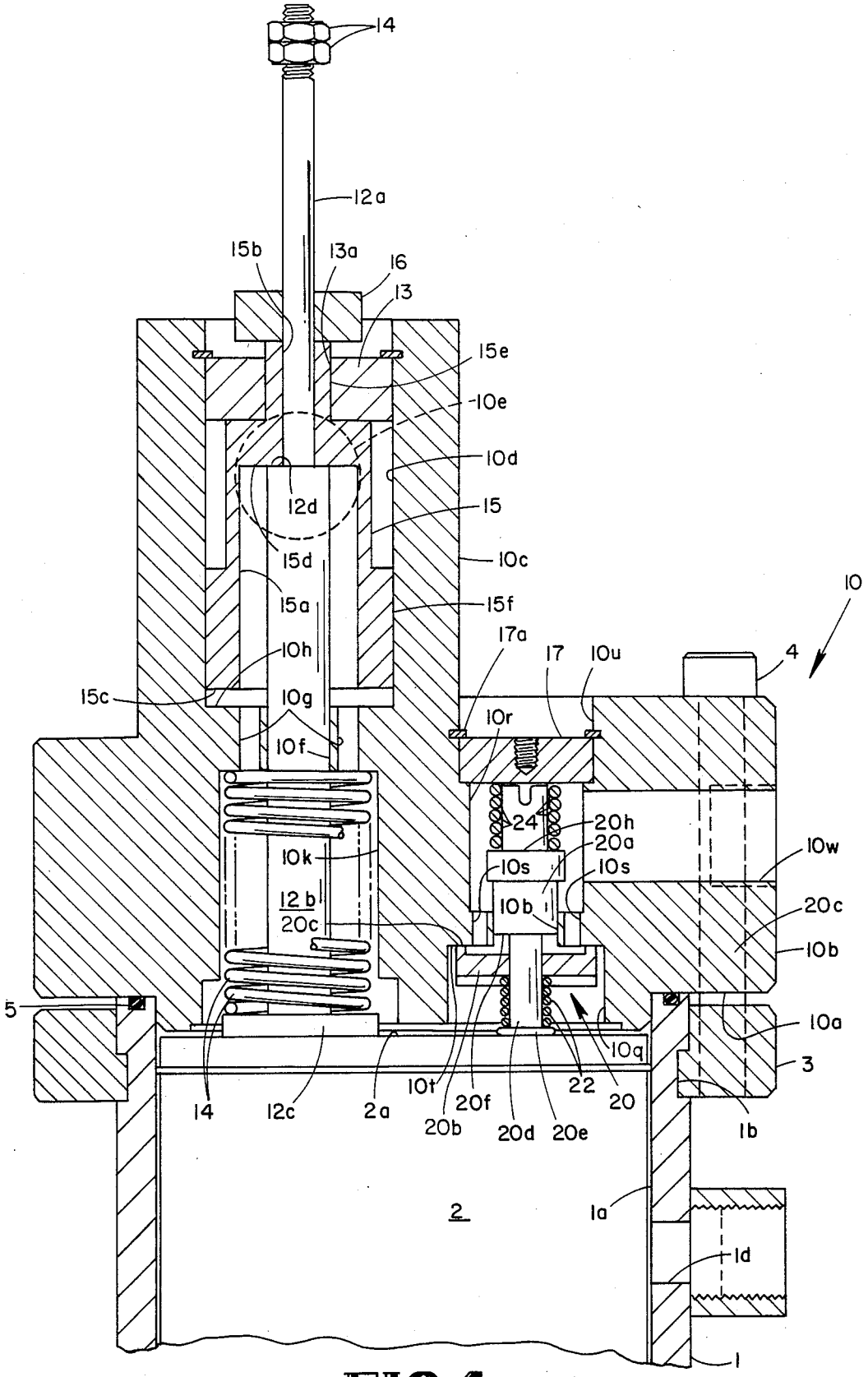
FIG. 4 is a view similar to FIG. 2 but showing the elements of the valving mechanism in their positions occupied at the extreme outer position of the piston with respect to the cylinder head.

A smaller bore 15*b* extends through the remainder of the body of valve 15 and slidably and sealably mounts the valve on a reduced-diameter outer stem portion 12*a* of an actuating rod 12. Rod 12 has an enlarged diameter inner portion 12*b* slidably and sealably mounted within the housing bore 10*f* and terminates in an enlarged head portion 12*c*. Head portion 12*c* abuts against one end portion of a compression spring 14 which is mounted within the counter bore 10*k* of the valve housing 10. Thus, head portion 12*c* of actuating rod 12 is normally positioned within the confines of cylinder 1 in position to be engaged by the piston 2 as it moves toward the cylinder head 10. When piston 2 reaches its extreme position relative to the cylinder head 10, as shown in FIG. 4, the head portion 12*c* fits within a second counter bore 10*m* provided in the end of the counter bore 10*k*.

The valving action is effected by the radial end surface 15*c* of the valving element 15 which cooperates in sealing relationship with the annular valve seat 10*h*, thus, closing inlet passages 10*g*.

The connection between the actuating rod 12 and the valve 15 constitutes a lost-motion connection, and comprises the radial shoulder 12*d* formed at the juncture of the stem portion 12*a* and the main body portion 12*b* of the actuating rod 12. Shoulder 12*d* must move a substantial distance outwardly through the fluid inlet chamber 10*d* until it contacts the bottom surface 15*d* of the counter bore 15*a* in valve 15 and then moves the valve 15 upwardly and out of sealing engagement with the annular valve seat 10*h*. As shown in FIG. 4, the movement of valve 15 is limited by its sealing contact with abutment ring 13.

Once the valve 15 moves off valve seat 10*h*, then the total area of the inwardly facing surfaces on the valve 15 substantially exceeds the area of the outwardly facing surfaces and hence, the valve 15 is biased by the fluid pressure supplied through inlet ports 10*e* to remain in its open position, as shown in FIG. 4, until it is again engaged by the actuating rod 12 to be returned to its closed or sealing position with respect to the annular valve seat 10*h*. Such closing action of the valve 15 is effected by a pair of nuts which are threadably engaged to the end of the stem portion 12*a* of the actuating rod 12 and retain a washer 16 on the stem portion 12*a*. When the piston moves away from the cylinder head 10, the actuating rod 12 follows the movement of the piston by the inward bias of the compression spring 14.

The proper functioning of a piston-cylinder arrangement wherein the limiting movement of the piston is not controlled by a crankshaft or a similar mechanism also requires an exhaust valve which functions in response to the position of the piston relative to the cylinder head. The exhaust valve embodying this invention is mounted in the cylinder head 10 in parallel relationship to the inlet valve 15. Thus, a bore 10*p* is provided in the cylinder head 10, and this bore is provided with an inner, large counter bore 10*q* and an outer, large counter bore 10*r*. A plurality of peripherally spaced exhaust passages 10*s* are provided around the bore 10*b*. An annular sealing surface or valve seat 10*t* is provided on the bottom of the inner counter bore 10*q* and surrounds all of the exhaust passages 10*s*. Exhaust passages 10*s* thus communicate with a radial exhaust passage 10*w* in cylinder head 10.

The outer counter bore 10*r* is further counterbored as indicated at 10*u*, and this provides a mounting for a cylindrical filler block 17 which is held in position in the bottom of counter bore 10*u* by a C-ring 17*a*.

A stem-type exhaust valve 20 is provided, having a stem portion 20*a* slidably and sealably mounted in the seal bore 10*p* and a radially enlarged head portion 20*b* defining an annular sealing surface 20*c* which is axially shiftable relative to the valve seat surface 10*t*. The head portion 20*b* is preferably formed as a separate disc-shaped element which is slidably mounted on a rod-like extension portion 20*d* of the exhaust valve 20. The end of extension portion 20*d* is provided with threads which accommodate a spring backing nut 20*e*. A compression spring 22 is provided which operates between the spring backing nut 20*e* and the inner surface of the valve head portion 20*b* to maintain such valve head portion in snug engagement with the shoulder 20*f* defined at the juncture of the rod extension portion 20*d* with the valve stem portion 20*a*. It will noted in FIG. 2 that the spring retaining nut 20*e* is normally positioned interiorly of the cylinder 1 and, hence, disposed in the path of the piston 2 as such piston approaches the end of the cylinder where cylinder head 10 is mounted.

Referring to FIG. 4, as the piston 2 completes its stroke toward the cylinder head 10, the spring retaining nut 20*e* is pushed outwardly by the piston, thus seating the exhaust valve 20 in sealing engagement with the annular valve seat 10*t* and thereby cutting off all fluid flow through the exhaust passages 10*s*.

Figure 2:
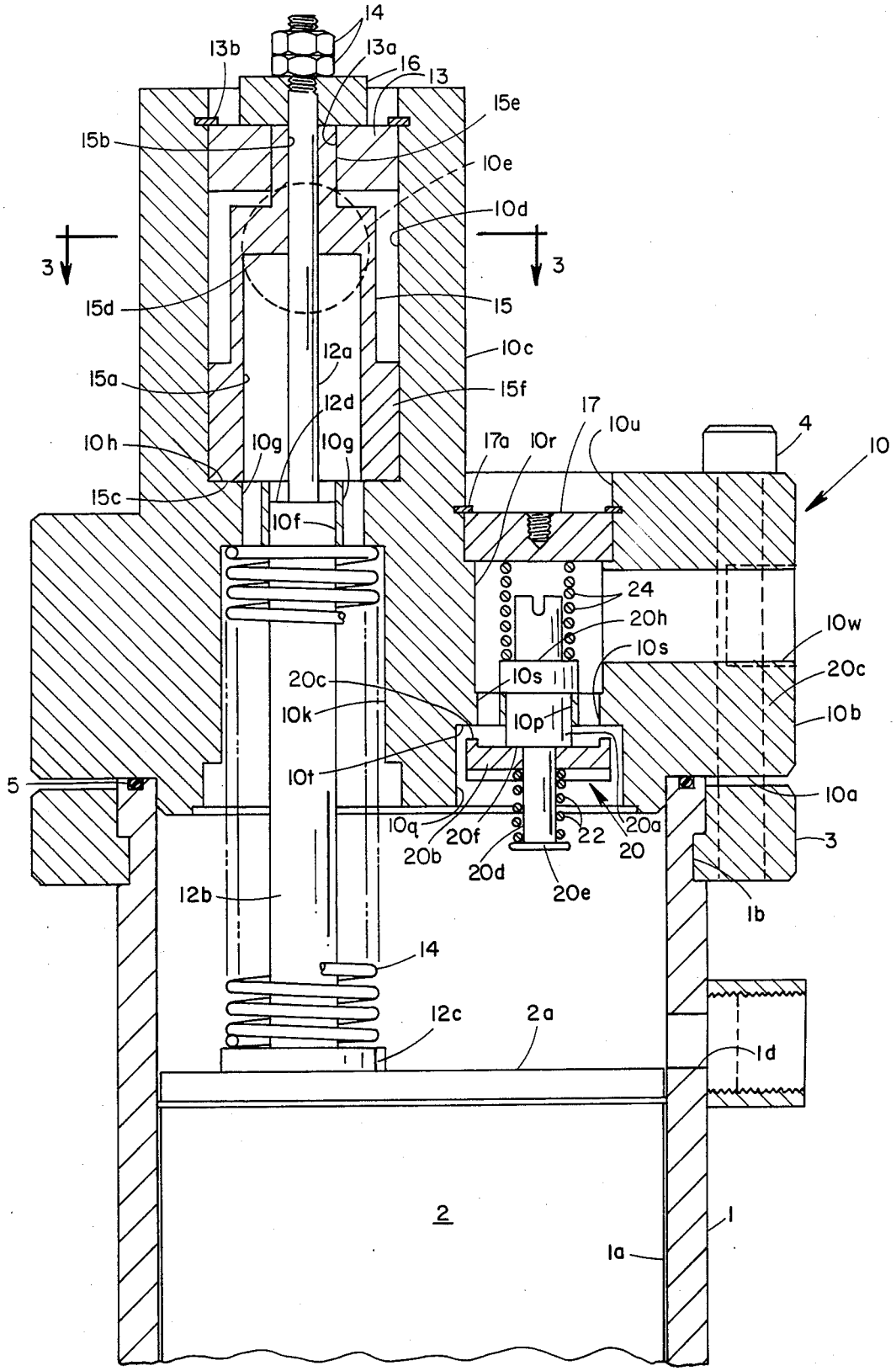
FIG. 2 is a sectional view taken on the plane 2—2 of FIG. 1.

When the piston 2 initiates its stroke in the opposite direction and moves in an inward direction relative to cylinder 1, the compression on spring 22 is relieved, but the gas pressure within the cylinder 1 is at a level substantially higher than the gas pressure existing in the discharge passage 10*w*. Hence, the exhaust valve 20 remains in its closed position until the gas pressure in the cylinder 1 is reduced to a level approximating that existing in the gas discharge passage 10*w*. Such reduction of gas pressure within a cylinder 1 may be accomplished in a variety of conventional manners such as, for example, the end face 2*a* of piston 2 passing beyond an exhaust port 1*d* provided in the wall of the cylinder 1 and connected either to the atmosphere or to the same gas removal system as the exhaust port 10*w* is connected to. Under these conditions, a relatively light compression spring 24 mounted between a shoulder 20*h* formed on the stem portion 20*a* of the exhaust valve 20 and the filler block 17 will shift the exhaust valve 20 sufficiently to move the annular sealing surface 20*c* out of engagement with the valve seat 10*t*, and thus re-open the exhaust fluid passages 10*s*, as indicated in FIG. 2.

From the foregoing description, it is apparent that the valving mechanism heretofore described will be effective to reliably control the movements of a piston relative to a cylinder. As the piston 1 approaches the cylinder head (FIG. 2), the exhaust valve 20 is fully open, thus permitting a free flow of gas pushed out of the cylinder bore 1*a* by the advancing piston 2, and the inlet valve 15 is closed. When the piston 2 strikes the head portion 12*c* of the actuating rod 12 of the inlet valve 15, nothing happens until the shoulder 12*d* on the actuating rod moves sufficiently to engage the internal surface 15*d* on the inlet valve 15. This does not occur until the end face of piston 2 engages and closes the exhaust valve 20 by striking the spring seat nut 20*e*. Thus the interior of the cylinder in advance of the piston is entirely enclosed and the remaining gases are rapidly compressed to provide a cushion to arrest the movement of the piston 1 toward the cylinder head 10 before the piston can strike the cylinder head.

At this point, the lost-motion connection between the actuating rod 12 and the inlet valve 15 has been used up and the shoulder 12*d* of the actuating rod engages the surface 15*f* of the inlet valve and moves the inlet valve to an open position. Pressured gas is thus permitted to flow through the inlet ports 10*e*, into the inlet chamber 10*d* and thence through the plurality of inlet fluid passages 10*g* into the interior of the cylinder 1. The pressure of such inlet gases acts on the inlet valve 15 to hold it in an open position due to the fact that there is a predominance of inwardly facing areas on valve 15 exposed to the inlet gas pressure. Thus, the inlet valve 15 remains in its open position until the piston 2 is driven inwardly to an extent to bring the washer 16 into contact with the outward end 15*e* of the valve 15 and, thus, forcibly move such valve to its closed position under the bias of the compressed spring 14. The exhaust valve 20, however, remains in its closed position due to the fluid pressure within the cylinder being substantially in excess of the fluid pressure in the gas discharge passage 10*w*. Exhaust valve 20 does open, however, when the piston 1 passes the radial port 1*d* and reduces the pressure in the cylinder 1 to approximately that existing in the discharge passage 10*w*. The opening of the exhaust valve 20 thus permits the piston 2 to freely move in the return direction towards the cylinder head 10 to repeat the aforedescribed cycle.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A piston-actuated inlet valve for a cylinder having a piston reciprocable therein, comprising a cylinder head sealably mounted on one end of the cylinder, said cylinder head defining a cylindrical pressured gas inlet chamber; a bore in said cylinder head concentric with the axis of said gas inlet chamber extending from said inlet chamber into the interior of said cylinder; a plurality of fluid inlet passages peripherally spaced around said bore; an annular valve seat surrounding all of the outer ends of said fluid inlet passages; a tubular valve having a tubular outer end slidably and sealably mounted relative to said cylindrical chamber and having an annular inner end face engageable with said valve seat in sealing relation; a valve-actuating rod slidably mounted in said bore and having an inner end portion projecting into said cylinder to be contacted by the piston as said piston approaches said cylinder head; said rod having an outer end portion slidable in the bore of said outer end of said tubular valve; resilient means urging said rod inwardly into the cylinder; a first abutment means on said outer end of said rod engaging said tubular valve, thereby biasing said tubular valve into sealing relation with said valve seat; a second abutment means on said rod engageable with said tubular valve after said rod is shifted outwardly a predetermined distance by said piston, thereby axially displacing said tubular valve from sealing engagement with said valve seat and permitting flow of pressured gas into the cylinder; whereby said pressured gas holds said tubular valve in an open position relative to said valve seat until said piston moves out of contact with said valve-actuating rod.

2. The apparatus of claim 1 wherein said first abutment means comprises an annular ring secured in a selected axial position on the outer end of said valve actuating rod by a threadably adjustable nut, thereby permitting adjustment of the period that said tubular valve permits flow of pressured gas into the cylinder.

3. The apparatus of claim 1 wherein said second abutment means comprises an integral shoulder defined by the diametrical difference between said bore of said outer end of said tubular valve and said bore in said cylinder head.

4. The apparatus of claim 1 further comprising means on said cylinder head limiting the axial movement of said tubular valve away from said valve seat, said movement-limiting means being sealingly engaged by an outwardly facing radial shoulder on said tubular valve, thereby producing an additional outward gas pressure bias on said tubular valve to hold same in an open position relative to said valve seat.

5. The apparatus of claim 1 in combination with an exhaust valve mounted in a second bore in said cylinder head; a plurality of exhaust gas passages surrounding said second bore; a second annular valve seat on said cylinder head surrounding the inner ends of said exhaust gas passages; said exhaust valve having a head portion sealingly engageable with said second valve seat and a stem portion slidable in said second bore; resilient means urging said exhaust valve inwardly to an open position relative to said second valve seat; and an actuating plunger resiliently connected to said exhaust valve and projecting into said cylinder into the path of said piston, whereby said exhaust valve is open as said piston approaches said cylinder head but is closed by said piston prior to said piston contacting said cylinder head and remains closed by gas pressure thereon as said piston is driven away from said piston head by the inlet of pressured gas through said inlet valve.

6. The apparatus of claim 5 further comprising means on said cylinder head limiting the axial movement of said tubular valve away from said valve seat, said movement-limiting means being sealingly engaged by an outwardly facing radial shoulder on said tubular valve, thereby producing an additional outward gas pressure bias on said tubular valve to hold same in an open position relative to said valve seat.

* * * * *